US005977939A

United States Patent [19]

Lee et al.

[11] Patent Number: 5,977,939

[45] Date of Patent: Nov. 2, 1999

[54] GAS FLAT DISPLAY TUBE

[75] Inventors: Keum Sik Lee; Byoung Jun Rhee, both of Seoul, Rep. of Korea

[73] Assignee: Youare Electronics Co., Seoul, Rep. of Korea

[21] Appl. No.: 08/678,895

[22] Filed: Jul. 12, 1996

Related U.S. Application Data

[62] Division of application No. 08/426,128, Apr. 21, 1995.

[30] Foreign Application Priority Data

Apr. 28, 1994 [KR] Rep. of Korea ..... 94-9165

[51] Int. Cl.[6] ..... G09G 3/10

[52] U.S. Cl. ..... 345/74; 313/585

[58] Field of Search ..... 345/74; 313/585

[56] References Cited

U.S. PATENT DOCUMENTS 3,646,382 2/1972 Goede et al. ..... 345/74
3,771,008 11/1973 Chen et al. ..... 313/486
3,775,633 11/1973 Sasaki et al. ..... 345/74
3,952,221 4/1976 Kamegaya et al. ..... 313/595
5,612,712 3/1997 Kumar et al. ..... 345/75
5,764,204 6/1998 Bancal ..... 345/74

*Primary Examiner*—Bipin H. Shalwala
*Assistant Examiner*—Vincent E. Kovalick
*Attorney, Agent, or Firm*—Jacobson, Price, Holman, & Stern, PLLC

[57] ABSTRACT

A gas flat display tube is disclosed including a glass container having a discharge gas therein; a plurality of cathodes extending horizontally and arranged by a predetermined interval in the glass container, for emitting electrons; a plurality of anodes extending vertically and arranged by a predetermined interval on one side of the glass container, for absorbing the emitted electrons; a plurality of phosphors arranged in a matrix form on the plurality of anodes and becoming luminous by the electrons absorbed into the anodes; and a plurality of gates extending vertically and arranged by a predetermined interval on the phosphors, for controlling the emitted electrons to be absorbed into the anodes.

22 Claims, 10 Drawing Sheets

GAS FLAT DISPLAY TUBE

This is a Divisional of application Ser. No. 08/426,128, filed Apr. 21, 1995.

BACKGROUND OF THE INVENTION

The present invention relates to a gas flat display tube for displaying figures and characters, and more particularly, to a gas flat display tube using a characteristic in which electrons and ultraviolet rays produced in discharge make different colors luminous according to phosphorus materials.

In a conventional technology, for a display tube for advertisement, a plurality of neon tubes are installed in which gases for illuminating different colors are injected, respectively, in order to display figures and characters. Specifically, for red illumination, neon is injected in the tube. For yellow, helium is injected therein. For blue, mercury is injected.

However, in the conventional display using the neon tube, the size of the neon tube is fixed to decrease the resolution. In addition, a plurality of neon tubes forming the display must become luminous, respectively, increasing power consumption.

SUMMARY OF THE INVENTION

Therefore, it is an object of the present invention to provide a gas flat display tube which enhances resolution and reduces power consumption by using a characteristic in which electrons and ultraviolet rays produced in discharge make different colors according to materials of phosphor.

To accomplish the object of the present invention, there is provided one embodiment of a gas flat display tube comprising: a glass container having a discharge gas therein; a plurality of cathodes extending horizontally and arranged by a predetermined interval in the glass container, for emitting electrons; a plurality of anodes extending vertically and arranged by a predetermined interval on one side of the glass container, for absorbing the emitted electrons; a plurality of phosphors arranged in a matrix form on the plurality of anodes and becoming luminous by the electrons absorbed into the anodes; and a plurality of gates extending vertically and arranged by a predetermined interval on the phosphors, for controlling the emitted electrons to be absorbed into the anodes.

For another embodiment of the present invention, there is provided a gas flat display tube comprising: a glass container having a discharge gas therein; first cathodes installed in the glass container and for emitting electrons; a plurality of anodes extending vertically and arranged by a predetermined interval on one side of the glass container, for absorbing the emitted electrons; a plurality of phosphors arranged in a matrix form on the plurality of anodes and becoming luminous by the electrons absorbed into the anodes; and a plurality of first gates extending horizontally and arranged by a predetermined interval in the glass container, for controlling the emitted electrons to be absorbed into the anodes.

BRIEF DESCRIPTION OF THE ATTACHED DRAWINGS

DETAILED DESCRIPTION OF THE INVENTION

Hereinafter, preferred embodiments of the present invention will be described in detail with reference to the attached drawings.

Cathode and anode electrodes are formed in a container filled with a gas. A power is applied thereto. When a predetermined voltage reaches, discharge is performed. Here, the voltage to be discharged is varied with the kinds of gas.

Since the electrons and ultraviolet rays produced in discharge have properties of making a phosphor luminous, red, green and blue phosphors are coated on the anode electrode. Here, the voltage current of the anodes and the voltage current of a gate are added or subtracted according to the intensity of luminescence.

The gas flat display tube is arranged in a horizontal and vertical matrix. Horizontally a horizontal drive pulse is applied, vertically a vertical drive pulse. At a point where they are in synchronization, discharge occurs.

Figure 1:
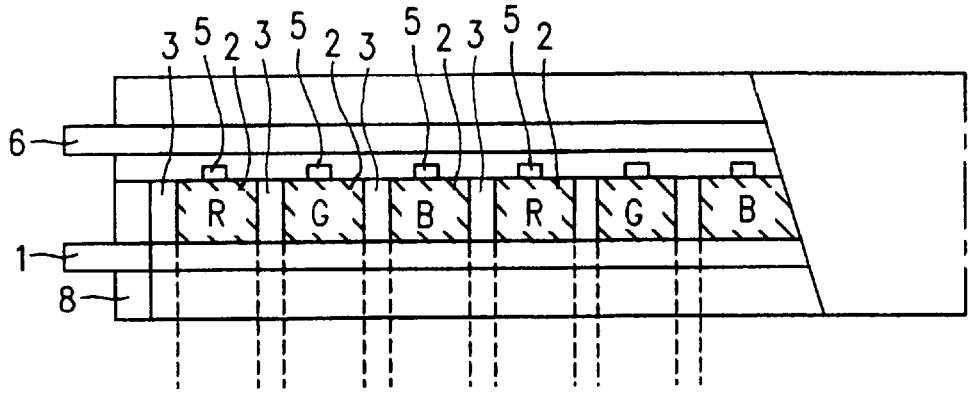
FIG. 1 is a cross-sectional view of one embodiment of the gas flat display tube of the present invention.
Figure 2:
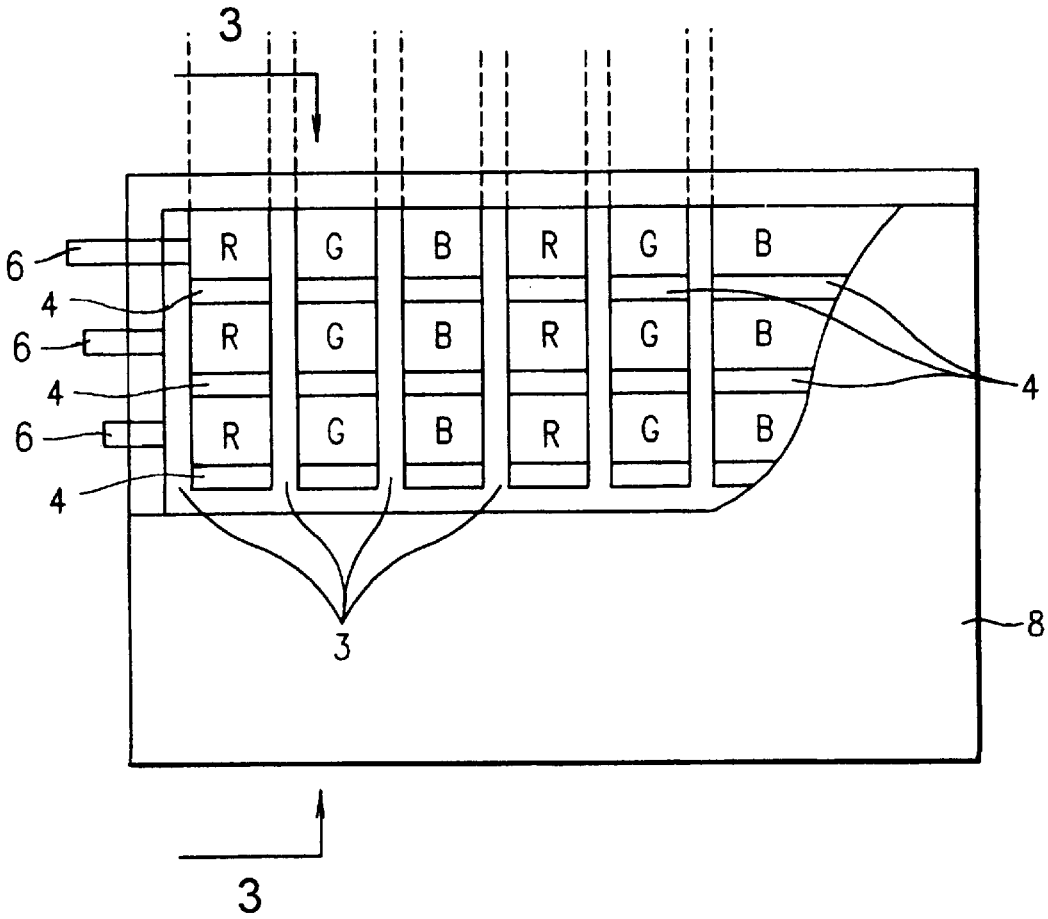
FIG. 2 is a front view of the gas flat display tube of the present invention shown in FIG. 1.
Figure 3:
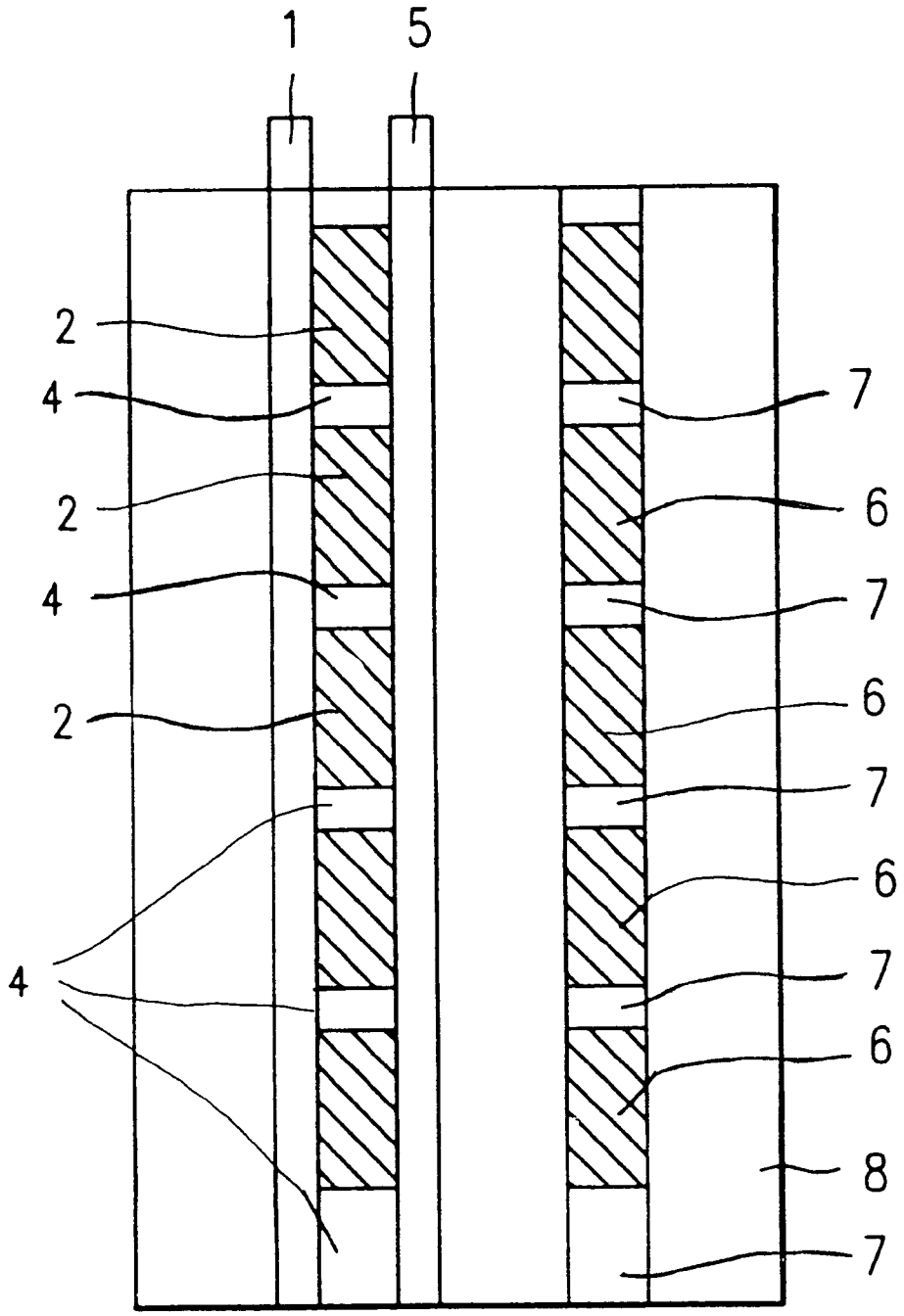
FIG. 3 is a cross-sectional view of the gas flat display tube cut along line A—A' of FIG. 2.

Referring to FIGS. 1, 2 and 3, one embodiment of the gas flat display tube of the present invention comprises a plurality of anodes 1, a plurality of cathodes 6, a plurality of phosphors, dielectrics 3, 4 and 7, a plurality of gates 5, and a glass container.

A positive power is supplied to anodes 1 and absorbs the electrons emitted from cathodes 6. The anodes are made up of vertical metal lines extending vertically and coated by a predetermined interval on one side of glass container 8. From a front view, they are vertical transparent metal lines. From a back view, they are vertical metal lines.

Anodes 1 are formed as many as the number of television horizontal scan lines, indicating the horizontal resolution, multiplied by numeral 3 which represents the number of color of phosphors, that is, red, green and blue. The electrode is protruded externally to receive a horizontal drive pulse.

Between the vertical lines of anodes 1 is formed a discharge-preventing dielectric 3 for the purpose of electric insulation.

Phosphors 2 are arranged horizontally in a matrix form on anodes 1 in the sequence of red, green and blue phosphors R, G and B so that they become luminous by the electrons absorbed into anodes 1.

The number of red, green and blue phosphors R, G and B is the same as that of the lines of anodes 1.

Here, in order to arrange the phosphors 2 in matrix, luminescence dielectrics 4 are disposed vertically by a predetermined interval so that they are as many as the number of cathodes 6, that is, the number of vertical drive pulses. Luminescence dielectrics 4 are for insulation and to prevent the blooming of the luminescence between the vertical drive pulses.

A negative power is supplied to cathodes 6 which extend horizontally opposite to anodes 1. The cathodes are coated with horizontal metal lines by a predetermined interval, or made with a wire, in plurality, as many as the vertical drive pulses. The electrode is protruded to receive the vertical drive pulse and emit electrons.

Gates 5 are electrodes for turning on or off the flow of electrons, extending vertically by a predetermined interval on phosphors 2. They are made with an aluminum-deposited, silver-deposited or printed wire, controlling the electrons to be absorbed to anodes 1.

Gates 5 are formed as many as anodes 1, that is, the horizontal drive pulses. The electrode is protruded to receive the horizontal drive pulses applied to corresponding anode 1, and a video signal.

Dielectric 7 is formed between the lines of cathode 6, so as to prevent discharge occurring due to the potential difference between cathodes 6.

Glass container 8 is formed of a plane glass. Anode 1, cathode 6 and gate 5 are incorporated therein. Discharge is performed in the container as a discharge gas is injected, according to specifications.

Red, green and blue phosphors R, G and B of anode 1 are grouped as one, and become luminous by the horizontal drive pulses received through anode 1 and gate 5, and the vertical drive pulses received to cathode 6. Colors are controlled according to a video signal input to gate 5.

The horizontal drive pulses are HIGH pulses corresponding to the horizontal sync signal of television. The HIGH pulses are generated the same number as that of the horizontal scan lines. They are applied to anodes 1 corresponding to red, green and blue phosphors R, G and B grouped into one. The vertical drive pulses are LOW pulses corresponding to a vertical sync signal and generated as many as the vertical scan lines. The pulses are applied to cathodes 6.

Until the horizontal drive pulses all are applied to one line of anodes 1 horizontally, in other words, until the horizontal drive pulses are applied as many as the red, green and blue phosphors R, G and B grouped as one, the vertical drive pulse is generated by one which stays LOW.

Here, only phosphors to which a HIGH horizontal drive pulse and LOW vertical drive pulse are applied is synchronized and becomes luminous.

Figure 4:
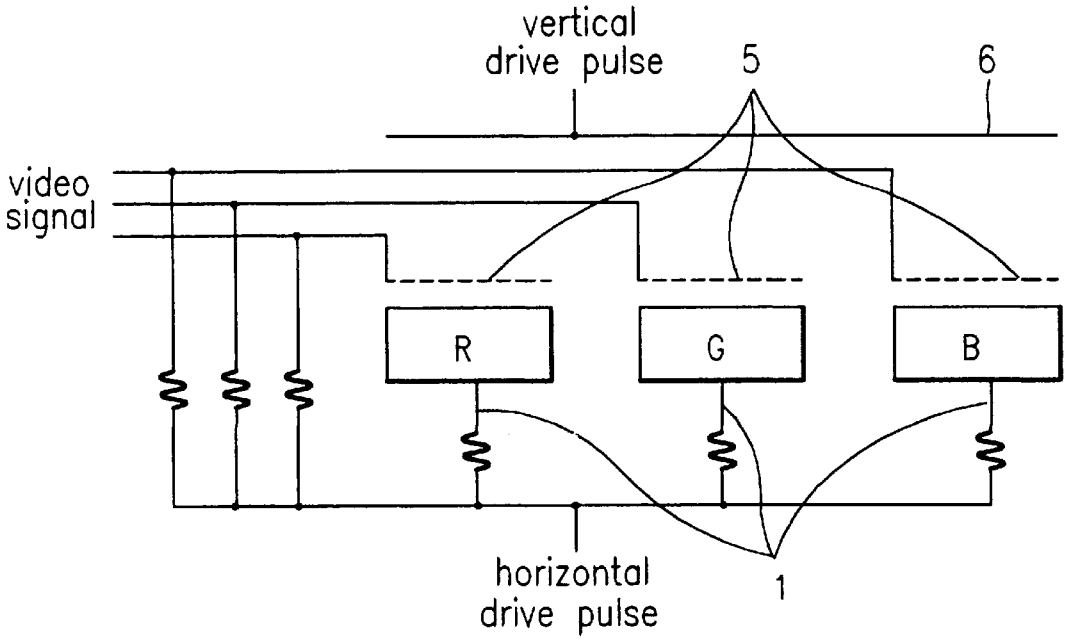
FIG. 4 is a structural diagram showing a signal input/output relationship in FIG. 1.

Referring to FIG. 4, in a case in which gates 5 are directed in the same direction and has the same number as that of anodes 1, the operation of one embodiment of the gas flat display tube of the present invention will be described below.

The HIGH horizontal drive pulse is applied to anodes 1, the LOW vertical drive pulse to cathodes 6. When a positive power is applied to corresponding anode 1, and a negative power is applied to corresponding cathode 6, a predetermined voltage is reached between corresponding anode 6 and cathode 7 according to the gas contained in glass container 8.

This means that when the horizontal drive pulse and vertical drive pulse are in synchronization, corresponding anode 1 and cathode 6 are discharged.

Since the horizontal drive pulse applied to anode 1 is fed to gate 5, a positive power is applied to corresponding gate 5 so that electrons reaching a predetermined voltage absorb the electrons discharged in anode 1 under the control of gate 5. This makes phosphor 2 luminous.

Here, a video signal is applied to gate 5 so that the brightness of red, green and blue phosphors R. G and B is varied, with colors being changed.

When the horizontal drive pulse and vertical drive pulse are synchronized, the color and brightness of the phosphors of red, green and blue R, G, and B coated on anodes 1 are formed by the video signal applied to gate 5. By doing so, the phosphors become luminous.

Here, the horizontal drive pulse input to anode 1 and gate 5 corresponding to a phosphor not to become luminous is LOW, and the vertical drive pulse input to cathode 6 is HIGH.

Figure 5:
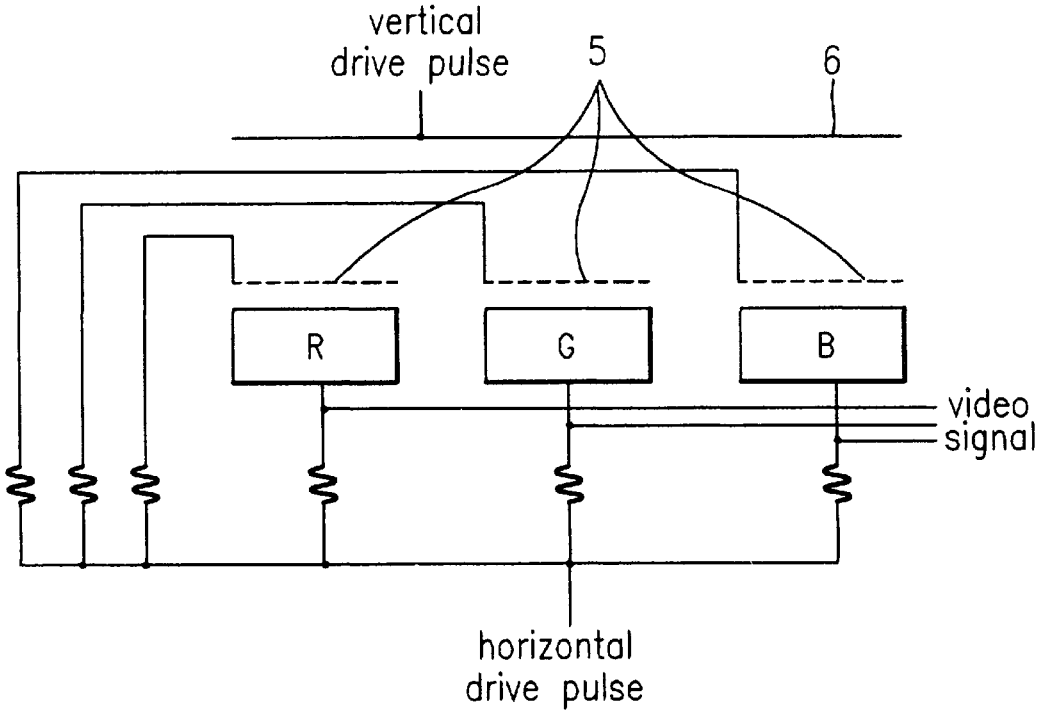
FIG. 5 is another structural diagram showing a signal input/output relationship in FIG. 1.

Referring to FIG. 5, in a case in which gate 5 and anode 1 are the same direction and number, the operation of the first embodiment of the gas flat display tube of the present invention will be described below.

When the horizontal drive pulse is applied to anode 1, the vertical drive pulse is applied to cathode 6, and positive and negative powers reach a predetermined voltage, phosphor 2 becomes luminous under the control of gate 5 applied to the horizontal drive pulse.

Here, a video signal is applied to anode 1 so that the brightness of red, green and blue phosphors R, G and B is varied to change colors.

In other words, when the horizontal and vertical drive pulses are in synchronization, the color and brightness of the phosphor of red, green and blue phosphors R, G and B are formed by the video signal applied to anode 1. This makes the phosphors luminous.

Figure 6:
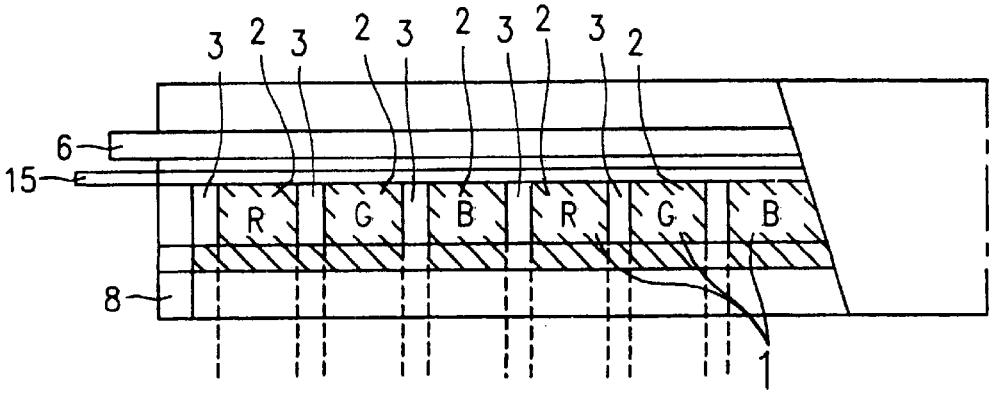
FIG. 6 is a cross-sectional view of another embodiment of the gas flat display tube of the present invention.
Figure 7:
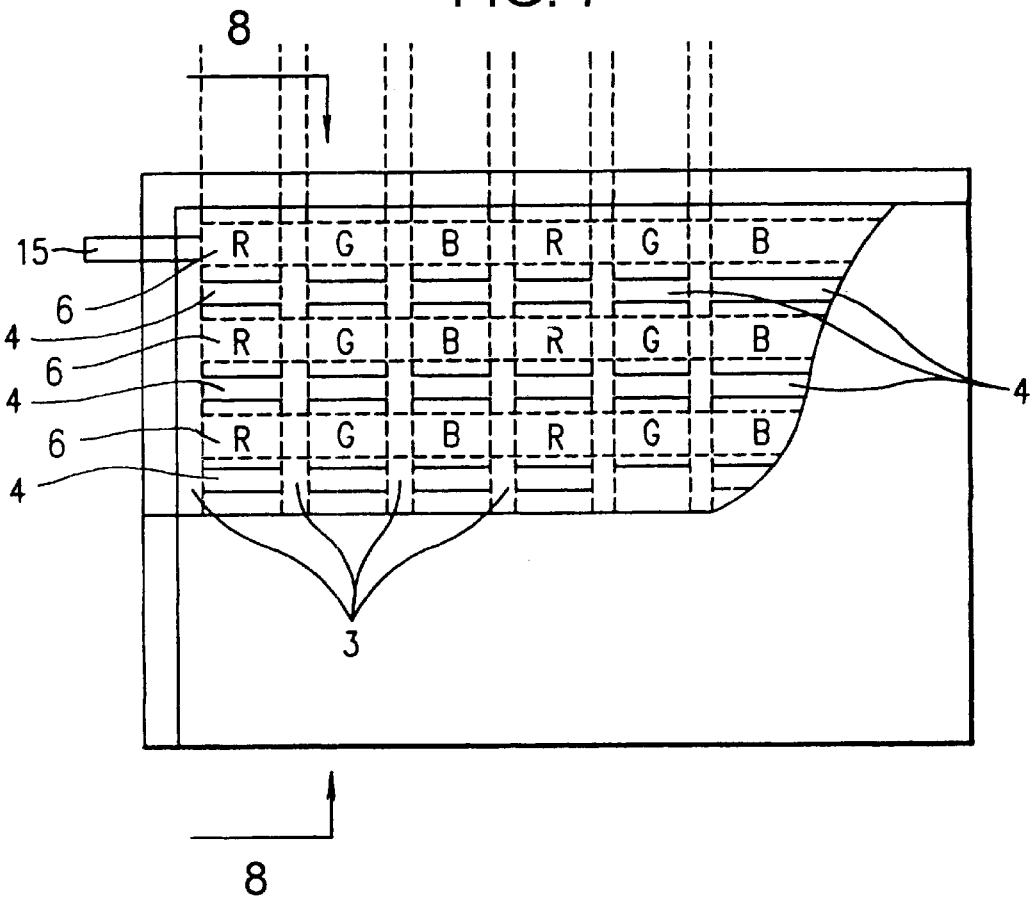
FIG. 7 is a front view of the gas flat display tube of the present invention shown in FIG. 6.
Figure 8:
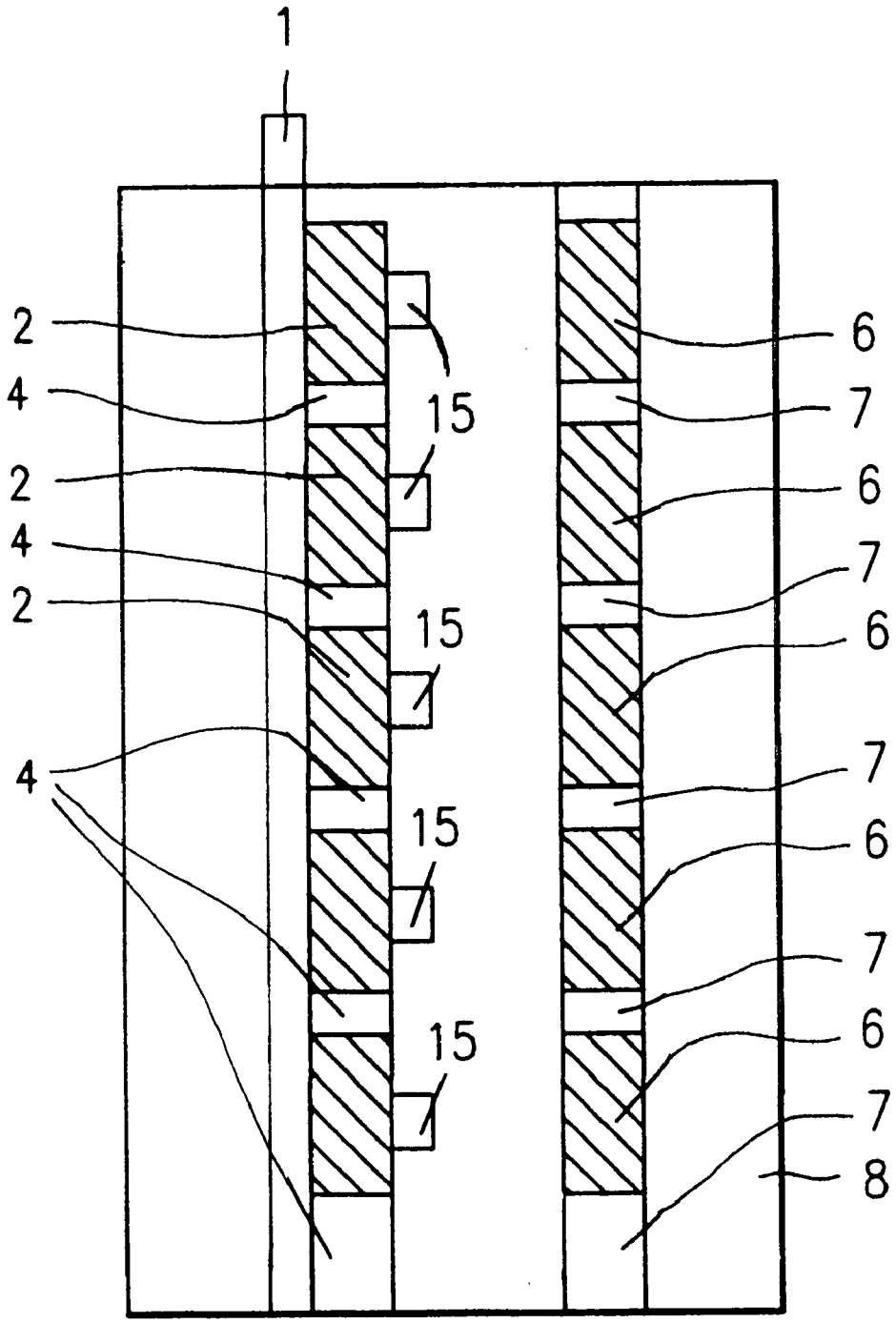
FIG. 8 is a cross-sectional view of the gas flat display tube cut along line B—B' of FIG. 7.

Another embodiment of the gas flat display tube of the present invention is the same as the first embodiment in configuration and operation, except gate 15, as shown in FIGS. 6, 7 and 8.

The second embodiment of the present invention comprises a plurality of anodes 1, a plurality of cathodes 6, a plurality of phosphors 2, dielectrics 3, 4 and 7, a glass container 8, and a plurality of gates 15.

Here, the anodes, cathodes, phosphors, dielectrics and glass container are the same as those of the first embodiment.

Gates 15 are electrodes for turning on or off the flow of electrons. Unlike the first embodiment, they extend horizontally by a predetermined interval along with cathodes 6 on phosphors 2, and are made with an aluminum-deposited, silver-deposited or printed wire. They control the electrons to be absorbed into anodes 1.

Gates 15 are formed in plurality as many as the vertical drive pulses, that is, cathodes 6. The electrode is protruded to receive the vertical drive pulses.

Figure 9:
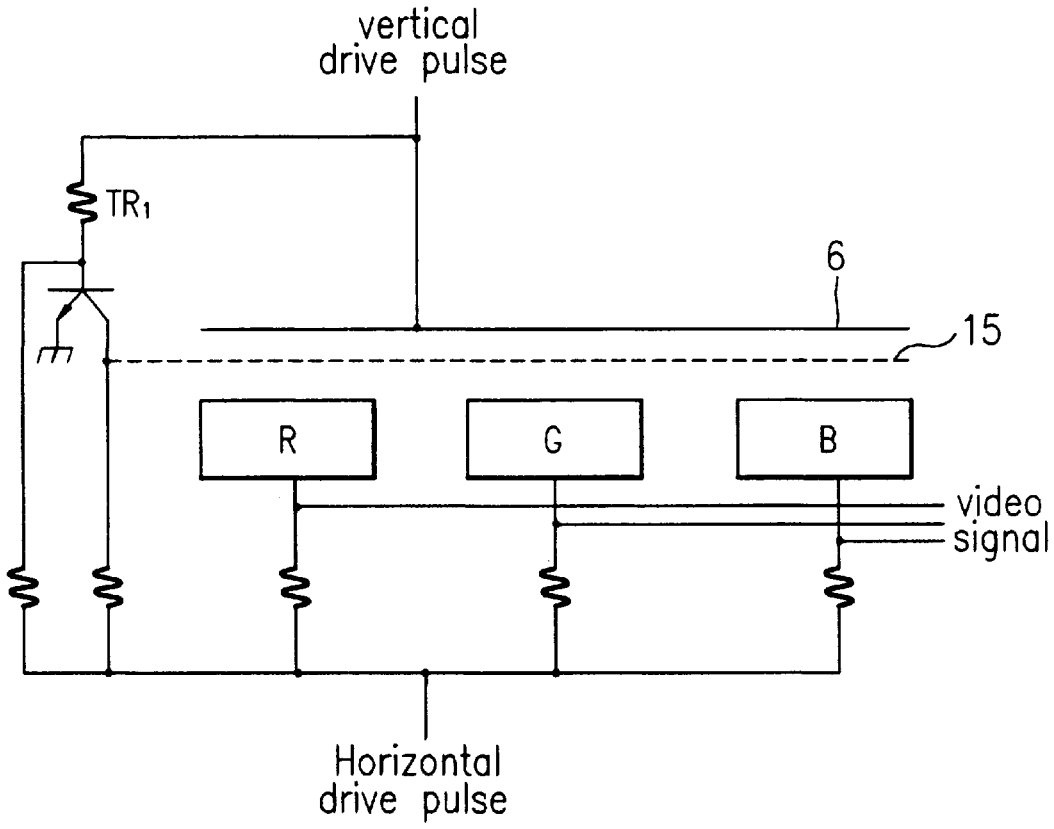
FIG. 9 is a structural diagram of a signal input/output relationship in FIG. 6.
Figure 10:
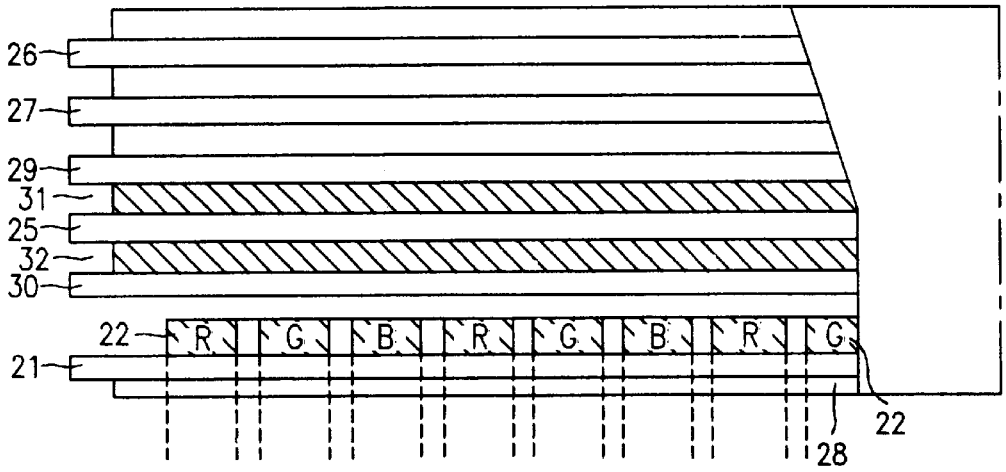
FIG. 10 is a cross-sectional view of still another embodiment of the gas flat display tube of the present invention.
Figure 11:
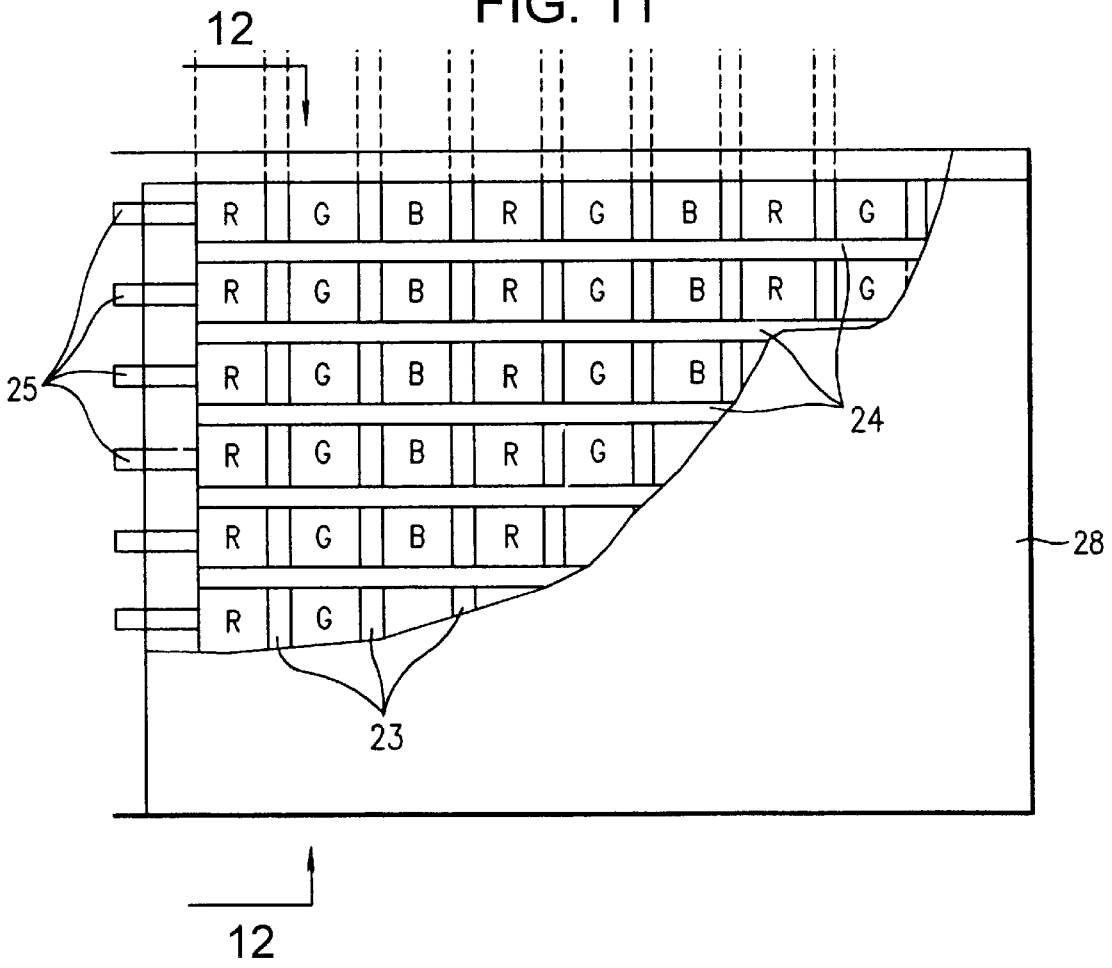
FIG. 11 is a front view of the gas flat display tube of FIG. 10.
Figure 12:
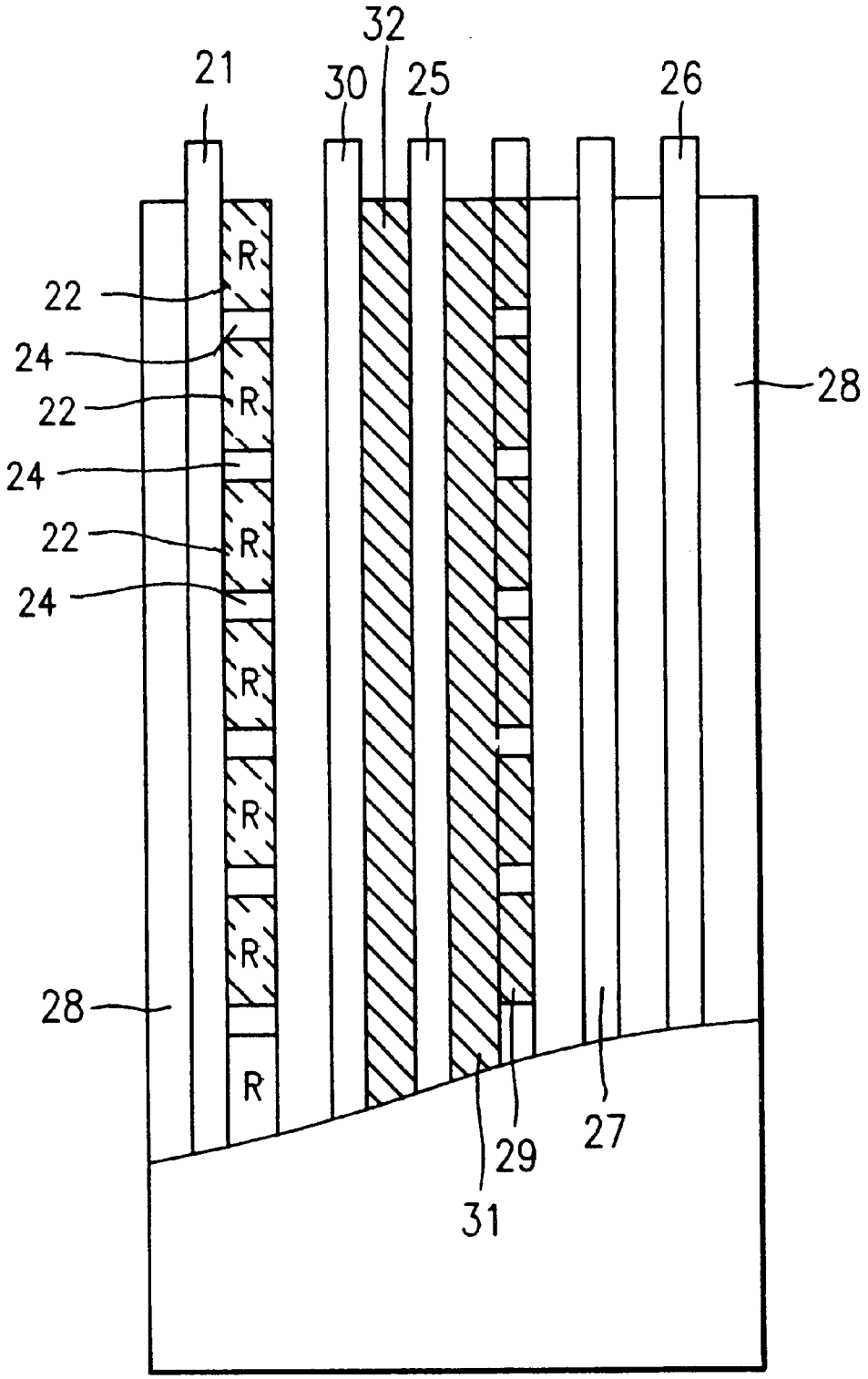
FIG. 12 is a cross-sectional view of the gas flat display tube cut along line C—C' of FIG. 11.
Figure 13:
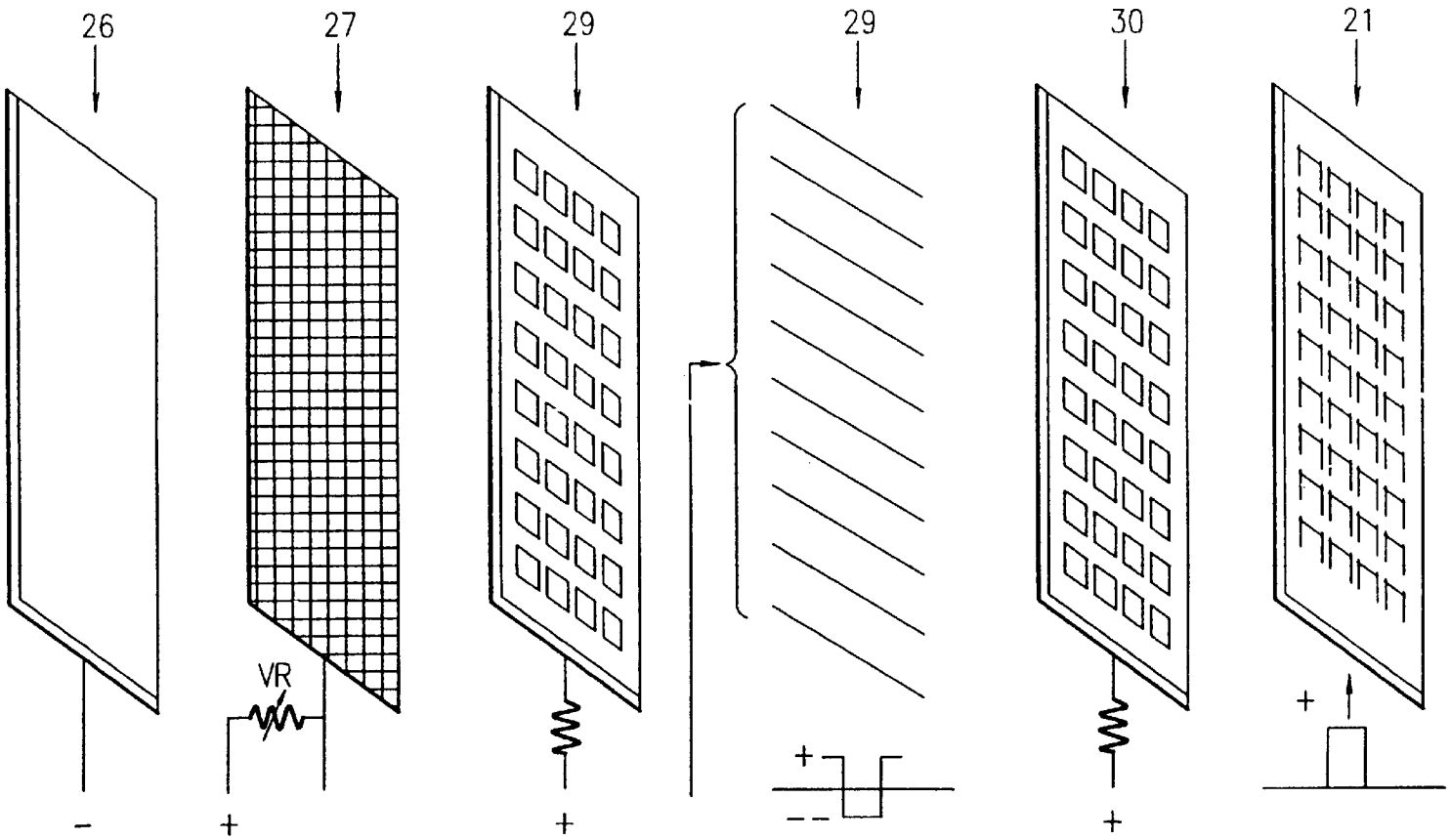
FIG. 13 is a structural diagram sequentially showing the components of FIG. 10.

Referring to FIG. 9, in a case in which gates 15 are the same direction and number as that of cathodes 6, the operation of the second embodiment of the gas flat display tube of the present invention will be explained below.

When the horizontal drive pulse is applied to anode 5, the vertical drive pulse to cathodes, a positive power is applied to corresponding anode 5, and a negative power to corresponding cathode 6, a predetermined voltage is reached between anode 6 and cathode 7 by the gas contained in glass container 8.

When the horizontal and vertical drive pulses are in synchronization, corresponding anode 5 and cathode 6 are discharged.

The vertical drive pulse applied to cathode 6 is fed to gate 15. At this time, the opposite potential is applied by a transistor $TR_1$.

Gate 15 has the same period as that of the vertical drive pulse, but the opposite potential thereto. That is, a HIGH vertical drive pulse is applied to the gate which then bears a positive potential.

Accordingly, as a positive power is applied to gate 15, the electrons reaching at the predetermined voltage make phosphor 2 luminous under the control of gate 15.

Here, a video signal is applied to anode 1 so that the brightness of red, green and blue phosphors R, G and B is varied to change colors.

In other words, when the horizontal drive pulse and vertical drive pulse are in synchronization, the color and brightness of the phosphors of red, green and blue phosphors R, G and B coated on anode 1 are formed by the video signal applied to anode 1 under the control of gate 15 to which an inverted vertical drive pulse is applied. Therefore, the phosphors become luminous. Here, the horizontal drive pulse input to corresponding anode 1 not to become luminous is LOW. The vertical drive pulse input to cathode 6 is HIGH. The inverted vertical drive pulse input to gate 6 is LOW.

As shown in FIGS. 10, 11, 12, and 13, still another embodiment of the gas flat display tube of the present invention comprises a plurality of anodes 21, first cathodes 26, second cathodes 27, a plurality of phosphors 22, dielectrics 23, 24, 31, and 32, second gates 29, a plurality of first gates 25, third gates 30, and a glass container 28.

A positive power is supplied to anode 21 so as to absorb the electrons emitted from first and second cathodes 26 and 27. The anodes extend vertically on one side of glass container 28 and are arranged by a predetermined interval. They are provided horizontally as many as the TV scan lines, which represent the horizontal resolution, multiplied by numeral 3 which indicates the number of colors, red, green and blue, of the phosphors. The electrode is protruded to receive the horizontal drive pulse and video signal.

A discharge-preventing dielectric is formed between the vertical metal lines of anodes 1 for the purpose of electric insulation.

Phosphors 22 are arranged horizontally in a matrix on anode 21 in the sequence of red, green and blue phosphors R, G and B along the anodes 21. They become luminous by the electrons absorbed into anodes 21.

For this reason, red, green and blue phosphors R, G and B are provided as many as the lines of anodes 21.

In this state, in order to arrange phosphors 22 in a matrix, luminescence dielectrics 24 are disposed vertically by a predetermined interval as many as the vertical drive pulses. Luminescence dielectrics 24 are for light insulation and to prevent the blooming of luminescence between the vertical drive pulses.

First cathodes 26 are for radiation and emit the electrons as they receive a negative power, being made with metal plates of nickel, tungsten, or etc. Such an oxide as alkali earth metal is coated on both sides of the cathodes, in which electrodes are protruded outwardly.

Second cathodes 27, discharge cathodes to which a positive power is applied, are formed on the side of first cathodes 26 in a net form of the same size as that of anodes 21. In order to help the electrons emitted from first cathodes 26 radiate, such an oxide as alkali earth metal is coated on both sides of the cathodes. The electrodes are protruded outwardly.

Second gates 29 are placed between second cathodes 27 and first gates 25, as accelerating grids to which a positive power is supplied. In the second gates, rectangular holes are provided horizontally as many as anodes 21 divided by numeral 3 which represents the number of colors, red, green and blue, of the phosphors, that is, as many as the horizontal drive pulses, and vertically as many as the first gates 25, that is, as many as vertical drive pulses, in a matrix. They accelerate the electrons emitted from first and second cathodes 26 and 27, and transmit them to first gates 25.

Dielectrics 31 are formed between second and first gates 29 and 25 so as to create electric insulation therebetween. They are, though varied with design dimensions, very thin.

First gates 25 are electrodes for turning on or off the flow of electrons, made with a wire of conductor of nickel or iron. They extend horizontally by a predetermined interval on dielectrics 31, and control the electrons to be absorbed into anodes 21. The anodes are provided vertically as many as the vertical drive pulses, in which electrodes are protruded to receive the vertical drive pulses.

Dielectrics 32 are formed between first and third gates 25 and 30 so as to create electric insulation therebetween. They are very thin although the thickness may be varied with design dimensions.

First gates 30, accelerating grids to which a positive power is supplied, are formed between dielectrics 32 and anodes 21. In the third gates, rectangular holes are provided horizontally as many as anodes 21 divided by numeral 3 which represents the number of colors, red, green and blue, of the phosphors, that is, as many as the horizontal drive pulses, and vertically as many as the first gates 25, that is, as many as the vertical drive pulses, in matrix. The third gates accelerate the electrons passing the first gates 25, and transmit them to anodes 21.

Glass container 28 is made with a plane glass, and incorporates anodes 21, first and second cathodes 26 and 27, and first, second and third gates 25, 29 and 30. For discharge, a discharge gas is injected into the container according to specifications.

Red, green and blue phosphors R, G and B of anodes 21, grouped as one, become luminous by the horizontal and vertical drive pulses input to anodes 21 and first gates 25. Their colors are controlled by the video signal input to the respective electrodes of anodes 21.

The horizontal drive pulse is a HIGH pulse corresponding to the horizontal sync signal of TV, with the vertical drive pulse being a LOW pulse corresponding to the vertical sync signal of TV. The horizontal drive pulse is generated as one which stays LOW until it is applied to all of one line of anodes 21. Here, only phosphors to which a HIGH horizontal drive pulse and a LOW vertical drive pulse are applied are synchronized to become luminous.

Figure 14:
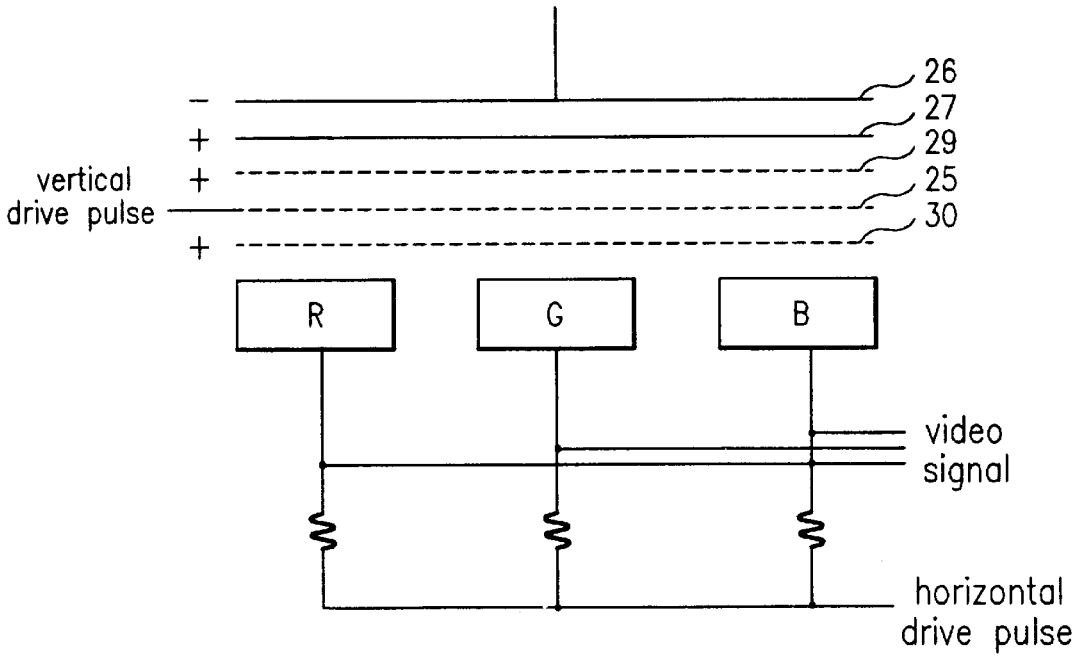
FIG. 14 is a structural diagram showing a signal input/output relationship in FIG. 10.

Referring to FIG. 14, the operation of the third embodiment of the gas flat display tube of the present invention will be described below.

When negative and positive powers are applied to first and second cathodes 26 and 27, discharge begins to increase electrons by geometric progression, as if electron avalanche.

At electron avalanche, the electrodes of first and second cathodes 26 and 27 may be damaged due to heat. For this reason, a variable resistor VR is connected to second cathodes 27 in order to prevent the electron avalanche.

In other words, just before the electrons of first and second cathodes 26 and 27 are produced as if electron avalanche, a positive power is applied to second gates 29 so that the electrons between first and second cathodes 26 and 27 are accelerated to pass through the holes of second cathode 29.

At this time, the vertical drive pulse is applied to first gate 25 so that the electrons passing through the holes of first gates 29 are accelerated only through first gate 25 to which the LOW vertical drive pulse is applied.

The electrons of one horizontal line passing through first gates 25 are re-accelerated by third gates 30 to which positive power is applied, and pass through the holes of third gates 30.

The horizontal drive pulse is applied to anode 21 to collide the electrons passing through the holes of third gates 30 against anode 21 to which a HIGH horizontal drive pulse is applied. This renders phosphor 22 coated on anode 21 luminous.

Here, a video signal is input to anode 21 so as to control the brightness of red, green and blue phosphors R, G and B and change the colors thereof.

What is claimed is:

1. A gas flat display tube comprising:

a glass container having a discharge gas therein;

first cathodes installed in said glass container an for emitting electrons;

a plurality of anodes extending vertically and arranged by a predetermined interval on one side of said glass container, for absorbing the emitted electrons;

a plurality of phosphors arranged in a matrix form on said plurality of anodes and becoming luminous by the electrons absorbed into said anodes; and a plurality of first gates extending horizontally and arranged by a predetermined interval in said glass container, for controlling said emitted electrons to be absorbed into said anodes, wherein the number of said first gates is same as that of vertical drive pulses so that said vertical drive pulses are applied to said first gates.

2. A gas flat display tube as claimed in claim 1, wherein said phosphors are formed horizontally in the sequence of red, green and blue phosphors on said plurality of anodes.

3. A gas flat display tube as claimed in claim 2, wherein the number of said anodes is the same as that of horizontal drive pulses by grouping red, green and blue phosphors as one so that said horizontal drive pulses are applied to said anodes.

4. A gas flat display tube as claimed in claim 3, wherein a video signal is applied to said anodes corresponding to said red, green and blue phosphors so as to change a luminous color.

5. A gas flat display tube as claimed in claim 1, further comprising second cathodes formed between said first cathodes and first gates and for radiating the electrons emitted from said first cathodes.

6. A gas flat display tube as claimed in claim 5, further comprising second gates formed between said second cathodes and first gates and for accelerating and transmitting the emitted electrons to said first gates.

7. A gas flat display tube as claimed in claim 6, wherein rectangular holes are formed in a matrix form in said second gates.

8. A gas flat display tube as claimed in claim 7, wherein said rectangular holes are formed vertically as many as the number of vertical drive pulses.

9. A gas flat display tube as claimed in claim 7, wherein said rectangular holes are formed horizontally as many as the number of horizontal drive pulses.

10. A gas flat display tube as claimed in claim 6, wherein a dielectric is formed between said first and second gates for the purpose of electric insulation.

11. A gas flat display tube as claimed in claim 5, further comprising third gates formed between said first gates and anodes and for accelerating and transmitting the electrons passing said first gates to said anodes.

12. A gas flat display tube as claimed in claim 11, wherein a dielectric is formed between said first and third gates for the purpose of electric insulation.

13. A gas flat display tube as claimed in claim 5, wherein said second cathodes are netlike and has the same size as that of said anodes.

14. A gas flat display tube as claimed in claim 13, wherein both sides of said first and second cathodes are coated of an oxide.

15. A gas flat display tube as claimed in claim 5, wherein a variable resistor for preventing an electron avalanche is coupled to said second cathode.

16. A gas flat display tube as claimed in claim 1, wherein said first cathodes are made with metal plates.

17. A gas flat display tube as claimed in claim 1, wherein said anodes are made up of vertical metal lines extending vertically and coated by a predetermined interval on said glass container.

18. A gas flat display tube as claimed in claim 17, wherein said third gates are formed in the same form as that of said second gates.

19. A gas flat display tube as claimed in claim 17, wherein a dielectric is formed between said vertical metal lines for the purpose of electric insulation.

20. A gas flat display tube as claimed in claim 1, wherein luminescence dielectrics are arranged vertically by a predetermined interval so that said phosphors are disposed in a matrix form.

21. A gas flat display tube as claimed in claim 20, wherein said luminescence dielectric is formed so that the number of said phosphors is the same as that of vertical drive pulses.

22. A gas flat display tube as claimed in claim 1, wherein said phosphors are arranged vertically as many as the number of said cathodes.

* * * * *